US005639310A

United States Patent [19]

Giampaolo, Jr.

[11] Patent Number: 5,639,310

[45] Date of Patent: Jun. 17, 1997

[54] METHOD FOR MANUALLY DISINFECTING AND CLEANING POST OR PIERCED EARRINGS

[76] Inventor: Joseph L. Giampaolo, Jr., 24 Bubenko Dr., Garnerville, N.Y. 10923

[21] Appl. No.: 258,523

[22] Filed: Jun. 10, 1994

[51] Int. Cl.[6] ..... B08B 7/00

[52] U.S. Cl. ..... 134/6; 134/7; 134/42; 422/28

[58] Field of Search ..... 134/6, 7, 42; 422/28

[56] References Cited

U.S. PATENT DOCUMENTS

| | | | |
|---|---|---|---|
| 3,570,036 | 3/1971 | Gilchrist et al. | 15/104.94 |
| 3,894,551 | 7/1975 | Stohlman | 134/135 |
| 4,282,891 | 8/1981 | Ducepee | 134/73.5 |
| 4,353,370 | 10/1982 | Evans | 128/269 |
| 4,530,726 | 7/1985 | Montiel | 134/6 |
| 4,787,516 | 11/1988 | Morrison | 206/566 |
| 4,813,538 | 3/1989 | Blackman | 206/210 |
| 4,872,235 | 10/1989 | Nielsen | 15/104 |
| 5,000,204 | 3/1991 | Smith | 134/6 |
| 5,000,209 | 3/1991 | Mann | 134/135 |

*Primary Examiner*—Zeinab El-Arini
*Attorney, Agent, or Firm*—Abelman, Frayne & Schwab

[57] ABSTRACT

A method for manually cleaning and disinfecting the post of a pierced-earring which includes moving the post in sliding contact with a pad of porous cellular material that is immersed in disinfecting solution, where the pad and solution are placed in a resealable, fluid-tight container. The disinfectant solution includes chlorhexidine gluconate.

16 Claims, 2 Drawing Sheets

METHOD FOR MANUALLY DISINFECTING AND CLEANING POST OR PIERCED EARRINGS

BACKGROUND OF THE INVENTION

1. Field of the Invention

The invention relates to the cleaning and disinfecting of the metal posts of pierced earrings that are inserted through the earlobes of wearers and that can become contaminated with dried blood or other organic and foreign matter. The cleaning and disinfecting can be accomplished in a commercial setting where the earrings are tried on by a number of different prospective purchasers, and by the individual owner while at home or traveling.

2. Discussion of the Prior Art

The cleaning and/or disinfecting of pierced earring posts has been accomplished by manual washing with soap and water or emersion in a liquid cleaning solution followed by drying with a cloth or tissue. Disinfecting of the earring posts is usually accomplished by manually applying alcohol with a cotton pad or tissue. These methods of manually cleaning the posts of pierced earrings are somewhat inconvenient, particularly in the context of a retail or commercial establishment where prospective customers may insert and remove several earrings before making a selection. The sales person would be required to apply alcohol to a cotton pad or tissue and cleanse the post before returning the earring to stock. This manual cleaning method may not be convenient for the individual wearer, where the alcohol is stored at a location different than that where the earrings are kept.

In view of the growing incidence of highly infectious and dangerous blood diseases such as HIV and hepatitis B, it is more important than ever to avoid the contact with such sources. It is known that a pierced earring post may prick the skin of the wearer as it is inserted into the earlobe, particularly if a pierced earring has not been worn for some time. In such an event, the post can become contaminated with a small amount of blood. Should this occur in a retail setting, where the earring may be removed and soon thereafter tried on by another customer, it is conceivable that live organisms could be passed to the second customer. Similarly, a friend or acquaintance may wish to try on or borrow another's earring, where the post could be contaminated with blood residue, organic or other foreign matter.

It is therefore an object of this invention to provide a method for conveniently and effectively cleaning and disinfecting the posts of pierced earrings. It is further object of this invention to provide such a method that can be readily practiced in a commercial or retail setting to quickly disinfect the posts so that the earring can be returned to stock in a clean and safe condition.

It is yet another object of the invention to provide a method that can be practiced inexpensively and easily by the individual owner at home or while traveling.

SUMMARY OF THE INVENTION

The method for manually cleaning and disinfecting the post of a pierced earring comprises moving the post into sliding contact with a pad of porous cellular material that is immersed in a container of a disinfecting or sterilizing solution so as to completely wet the post with the solution and remove any accumulated foreign matter by the effect of the mechanical or abrading contact with the porous cellular pad. The cellular pad can be a piece of natural or synthetic sponge material and is preferably an open-celled foam material produced from synthetic polymers.

An open-celled foam is preferable because is permits complete saturation of the foam structure by the disinfecting or germicidal solution. An open-celled foam structure also permits the post to more easily penetrate the upper surface of the foam pad, and thereby penetrate into the foam structure for the mechanical or frictional scrubbing of the post to remove any accumulated foreign matter.

The composition of the foam material should be selected so that it is not adversely affected by prolonged contact with the cleaning solution in which it is immersed. The foam should also be of the high resiliency type so that it can provide the abrading surfaces without being torn or shredded. An open-celled, high resiliency polyurethane foam can be used for the pad. In a preferred embodiment, the open-celled polyurethane foam is coated with another polymer such as polyvinochloride (PVC) in order to provide greater strength and improved abrading qualities. Other types of polymer foams that can be used in practicing the method of the invention include polyvinyl chloride, polyolefins, such as polyethylene, polyprophylene, and polycarbonate, as well as various copolymers and modified compositions, such as those containing ABS. The type of foam to be used and its quantities will be apparent to those of ordinary skill in the art, in view of the description of the invention.

In a preferred embodiment, the foam sponge or pad is provided with one or more recesses into which the post of the earring can be inserted to facilitate the sliding contact with the interior of the foam. For example, the surface of the foam pad can be provided with one or more slits into which the post can be inserted and then moved in sliding relation to the pad to maximize the abrading contact with the interior structure of the foam pad. Alternatively, a generally cylindrical cavity or opening can be provided through the surface of the foam pad and the post can be moved in a circular pattern around the vertical side walls of the cylindrical opening to thoroughly clean any foreign matter from the post. A combination of slits and holes can be provided in the same pad. Typically, the posts of pierced earrings do not exceed 15 millimeters in length, and the slits and openings in the foam pad need only be slightly deeper to provide the optimum cleaning effect.

The pad can be cut to the desired shape from a pre-formed sheet or block of cellular material. Alternatively, the pad can be produced in the desired size and shape from a liquid resin composition by expansion molding.

In another preferred embodiment for practicing the method of the invention, opposing surfaces of the sponge pad are provided with slits and/or openings to permit the other side of the pad to be used when the first side becomes worn.

Although the pad can be of any convenient size and shape, in a preferred embodiment, the pad is placed inside of a resealable container, such as a glass or plastic jar having a screw cap. When a resealable jar is used, the configuration of the foam pad is generally cylindrical with planar top and bottom surfaces. Other container configurations can be used, such as rectilinear plastic and metal boxes having a hinge top that provides a fluid-tight seal when closed.

The container can also be adapted to fit into a separate base unit which will provide added stability to the container during use in the disinfecting and cleaning of the earring post. The base unit can be made of the same material as the resealable container, and if necessary provided with a separate metal weight to provide additional stability to the unit.

A thin piece of flat or sheet of non-slip material can be secured to the base unit.

After the pad is placed into the container, it is immersed in a disinfecting or germicidal solution. The solution can be formulated from any number of ingredients having germicidal properties. The disinfecting and cleaning solution is selected to avoid adverse affects on the composition used for the pad. The use of harsh chemicals that would cause irritation to the skin of the user is to be avoided, since contact with at least the finger tips of the individual holding the earring during cleaning is likely.

An effective disinfecting solution can be prepared from a mixture of isopropyl alcohol and water, and can also contain germicide such as chlorhexidine gluconate. A liquid soap or detergent and one or more surfactants can also be added to assist in the cleaning and removal of foreign matter from the post. A liquid composition can also include an additive to provide the product with a mild scent or fragrance.

Commercial household cleaning products can also be used in the practice of the invention. Liquid cleaners such as those sold as general-purpose cleaners for domestic kitchens and bathrooms can also be used alone, or in combination with alcohol and other stable liquid formulations having germicidal properties. Other commercial products containing alcohol in germicidal quantities, can also be used, alone or in combination with liquid soaps, surfactants and detergents.

The invention thus provides an effective and inexpensive method for disinfecting and cleaning the posts of pierced earrings that is convenient for use by sales personnel in a commercial or retail setting, as well as for use by individuals at home or while traveling.

DETAILED DESCRIPTION OF THE INVENTION

Figure 1:
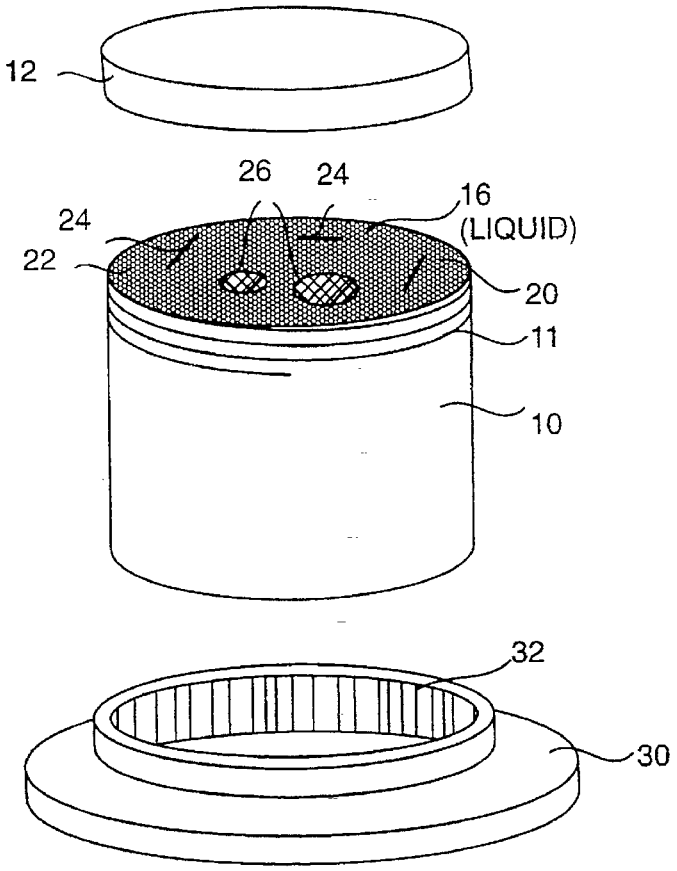
FIG. 1 is a perspective view of a resealable container, cover and optional base unit that is provided with a pad adapted for use in the method of the invention.

As shown in FIG. 1, a resealable glass or plastic container is provided with exterior threads 11 at its open end that are adapted to receive threaded cap 12 to provide a fluid-tight seal. A close fitting sponge or polymer pad 20 is placed in container 10 having a planar upper surface 22 positioned proximate the opening of the container. Surface 22 is provided with one or more slits 24 which are adapted to receive the post of a pierced earring to permit vertical and horizontal movement along the entire surface of the post to accomplish the cleaning and disinfecting. In addition, surface 22 can be provided with one or more vertical openings 26 of a generally cylindrical configuration that are adapted to permit the manual cleaning of the posts by a rotary motion of the post against the inside surface of the circumference of the hole 26.

Also shown in FIG. 1 is an optional base unit 30 having central opening 32 adapted to receive container 10 in a close-fitting relationship. Base unit 30 can be made of molded plastic or metal to provide stability to the container during use. In a preferred embodiment, base unit 30 is constructed with flange 34 to provide a flat surface that can be held by the thumbs and fingers of the user during the cleaning operation. Container 10 and optional base unit 30 can be ornamental in appearance and constructed with an attractive aesthetic design that will enhance their appearance on the counter of a jewelry store or a dressing table. The base unit 30 can also be provided with a thin piece of felt or a sheet of non-slip material 35 on its lower surface to improve its stability and to avoid marring of the surface on which it is placed.

Figure 2:
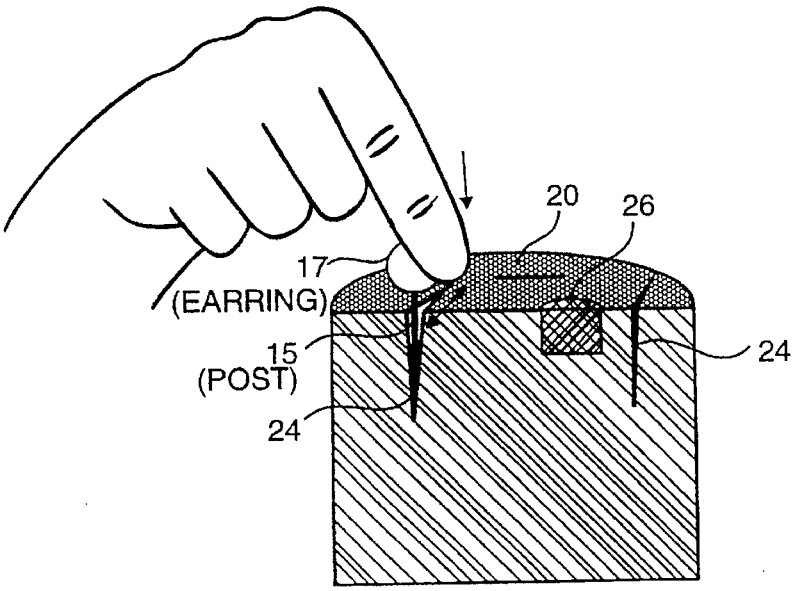
FIG. 2 is a cross-sectional view of the container and pad shown in FIG. 1.

As shown in the sectional view of FIG. 2, the slits 24 and the openings 26 in pad 20 are deep enough to receive the entire length of the post 40 of a pierced earring 42 and to permit its easy manual movement during the cleaning and sterilizing step of the method. Although the cleaning of the post is most conveniently accomplished by contacting the inner surfaces of slit 24 or opening 26, the post can also be treated by pressing it into surface 20 for its full length and moving it against the internal structure of the pad. As will be apparent, the opening of the container should be large enough to accommodate the thumb and finger of the individual holding the earring. The container opening should be at least two inches in diameter, or in its minimum dimension.

Figure 3:
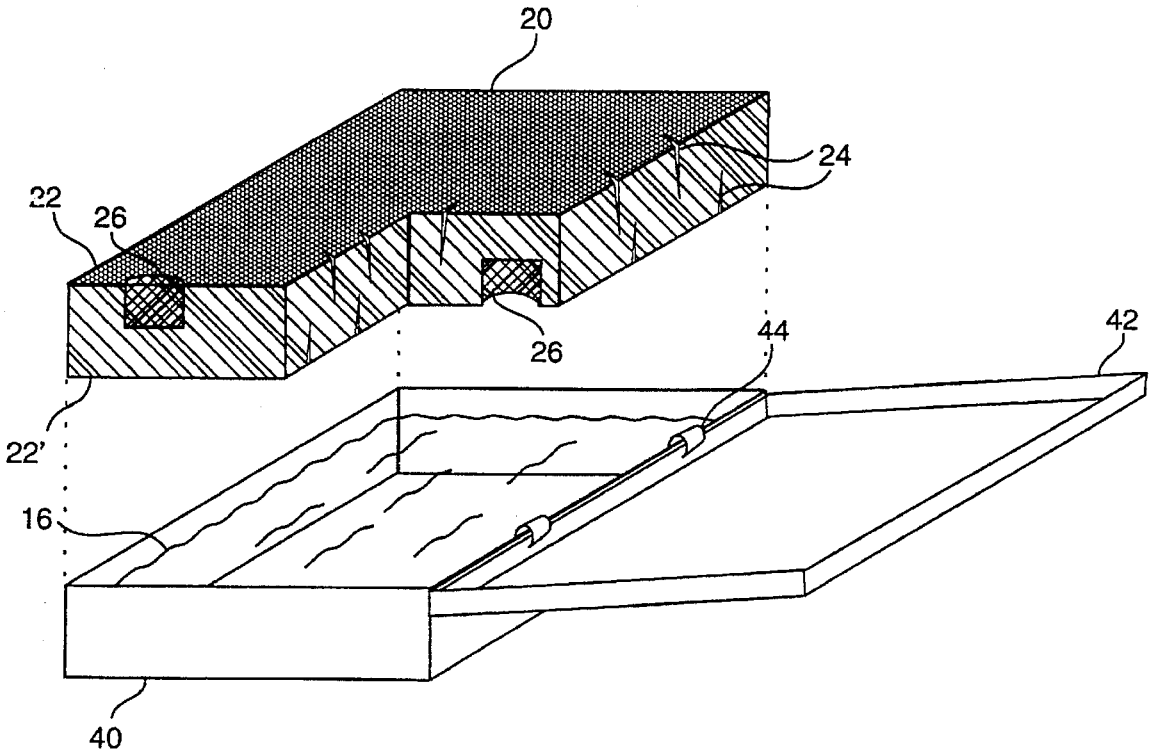
FIG. 3 is an exploded perspective view showing a partially cut-away view of a pad and a container adapted for use in another embodiment of the method of the invention.

FIG. 3 shows another embodiment in which the pad and its container are of a generally rectilinear configuration. In this embodiment, the upper surface 22 and lower surface 22' of pad 20 are both provided with slits 24 and/or generally cylindrical openings or cavities 26 so that the pad can be reversed when one side becomes worn. In this embodiment, container 40 is provided with an integral resealable lid 42 secured to the base by hinges 44. The container 40 is filed with disinfecting solution 16 to a level that will saturate pad 20 to its exposed surface 22 during use.

A rectilinear container can be produced as a one-piece construction from thermo-formed polypropylene or PVC resins of clam shell construction with a lining hinge, and provided with seals to prevent leaking and the escape of volatile materials from the cleaning composition.

I claim:

1. A method for manually disinfecting a post of a pierced earring which comprises moving the entire length of the post in sliding abrading contact with a pad of porous cellular material, which cellular material is immersed in liquid disinfecting solution to thereby completely wet the post with said disinfecting solution, where the disinfecting solution comprises chlorhexidine gluconate.

2. The method of claim 1 where the porous cellular material is produced from a polymer.

3. The method of claim 2 where the cellular material is an open-cell polymer foam.

4. The method of claim 3 where the cellular material has a high resiliency.

5. The method of claim 2 where the cellular material is an open-cell polyurethane foam coated with polyvinylchloride.

6. The method of claim 1 where a surface of the pad is provided with one or more slits adapted to receive the post.

7. The method of claim 1 where the pad is provided with one or more vertically oriented cavities adapted to receive the post.

8. The method of claim 1 where the pad is cylindrical and its contact surface is at least about two inches in diameter.

9. The method of claim 1 where the pad is in a resealable container.

10. The method of claim 9 where the container is a threaded jar adapted to receive a screw cap.

11. The method of claim 9 in which the pad is adapted to be reversibly positioned in the container to expose a lower surface for contact with the post.

12. The method of claim 9 where the container is placed in a stabilizing base unit.

13. The method of claim 1 where the disinfecting solution comprises isopropyl alcohol.

14. The method of claim 13 where the solution contains a fragrance additive.

15. A method of cleaning and disinfecting a post of a pierced earring following removal from the wearer's ear comprising manually moving the post to penetrate an upper surface of a cellular foam material contained in a liquid disinfectant solution to completely wet the post and moving the post in sliding abrading contact with the foam material over length of the post to thereby remove any foreign matter form the post, where the disinfecting solution comprises chlorhexidine gluconate.

16. A method for cleaning and disinfecting a post of a pierced earring that comprises moving the post through a liquid disinfecting solution to completely wet the post and simultaneously contacting throughout the length of the post a stationary means for abrading the post to thereby remove foreign matter from the post, where the disinfecting solution comprises chlorhexidine gluconate.

* * * * *